US006863469B2

(12) United States Patent
Bolduc et al.

(10) Patent No.: US 6,863,469 B2
(45) Date of Patent: Mar. 8, 2005

(54) INTERLOCKING PAVING STONE

(75) Inventors: Yvan Bolduc, Ste-Marie de Beauce (CA); Maurice Bolduc, Ste-Marie de Beauce (CA)

(73) Assignee: Beton Bolduc Inc., Quebec (CA)

( * ) Notice: Subject to any disclaimer, the term of this patent is extended or adjusted under 35 U.S.C. 154(b) by 0 days.

(21) Appl. No.: 10/167,051

(22) Filed: Jun. 10, 2002

(65) Prior Publication Data

US 2003/0007834 A1 Jan. 9, 2003

Related U.S. Application Data

(60) Provisional application No. 60/296,439, filed on Jun. 8, 2001.

(51) Int. Cl.[7] ..... E01C 5/00
(52) U.S. Cl. ..... 404/41; 404/34
(58) Field of Search ..... 404/32, 33, 34, 404/35, 37, 38, 39, 40, 41, 42; 405/284, 286, 262

(56) References Cited

U.S. PATENT DOCUMENTS

| | | | | | |
|---|---|---|---|---|---|
| 130,027 | A | * | 7/1872 | Dyer | 404/41 |
| 510,259 | A | * | 12/1893 | Higgins | 404/29 |
| 3,221,614 | A | * | 12/1965 | Pertien | 404/41 |
| 3,602,111 | A | * | 8/1971 | Laguardia Clemente | 404/41 |
| 3,873,225 | A | * | 3/1975 | Jakobsen et al. | 404/41 |
| D262,742 | S | * | 1/1982 | Vesterholt | D25/113 |
| 4,320,612 | A | * | 3/1982 | Jeffries, Jr. | 52/396.08 |
| D283,551 | S | * | 4/1986 | Repasky | D25/113 |
| D284,514 | S | * | 7/1986 | McPoyle | D25/118 |
| 4,671,039 | A | * | 6/1987 | Hunt | 52/591.2 |
| 4,896,999 | A | * | 1/1990 | Ruckstuhl | 405/286 |
| 5,020,938 | A | * | 6/1991 | Scales | 405/16 |
| 5,052,158 | A | * | 10/1991 | D'Luzansky | 52/177 |
| 5,133,620 | A | * | 7/1992 | Scheiwiller | 404/37 |
| 5,182,892 | A | * | 2/1993 | Chase | 52/539 |
| 5,222,342 | A | * | 6/1993 | Defferrari | 405/284 |
| 5,902,069 | A | * | 5/1999 | Barth et al. | 404/34 |
| 5,941,657 | A | * | 8/1999 | Banze | 404/39 |
| 6,263,633 | B1 | * | 7/2001 | Hagenah | 52/596 |
| 6,471,440 | B1 | * | 10/2002 | Scheiwiller | 404/39 |

* cited by examiner

*Primary Examiner*—Robert E. Pezzuto
*Assistant Examiner*—Alexandra K. Pechhold
(74) *Attorney, Agent, or Firm*—Darby & Darby

(57) ABSTRACT

An interlocking paving stone of rectangular or square shape, the stone having a width W, a length L, and a thickness H. Each side of the stone is provided with at least one pair of alternating tongues and grooves on a bottom part thereof, having a size and shape adapted to receive a corresponding tongue or groove of an adjacent block. The groove has an overall volume greater than the volume of the tongue to facilitate the pouring of joint filling materials. The length of a pair of tongue and groove is equal to a length I, where both W and L are whole multiples of I. Furthermore, the tongues and grooves have a generally truncated pyramidal shape, where the peak of the truncated pyramid lies below the top surface of the block by 40 to 50% of the total height of the stones. The stone according to the present invention provides greater lateral and vertical stability to an assembled pavement.

6 Claims, 20 Drawing Sheets

INTERLOCKING PAVING STONE

This application claims the priority of U.S. Provisional Application No. 60/296,439, filed on Jun. 8, 2001 which is hereby incorporated hereby by reference in its entirety.

FIELD OF THE INVENTION

The present invention relates to an interlocking paving stone or slab, and more specifically, to such a stone which can accommodate both horizontal and vertical loads among stones, and which can be made in a rectangular or square shape with a variety of sizes in order to create different patterns of installation.

DESCRIPTION OF THE PRIOR ART

Interlocking paving stones are well known in the art and usually include a shape that allows a lateral interlock of a plurality of stones together in order to form a pavement. In each stone pavement, joint filling material is inserted between the stones to achieve the necessary elasticity of the surface and for supporting the stones among themselves, i.e. for the accommodation of horizontal forces.

One of the problems associated with such stones is that they cannot transfer a large vertical load to the neighboring paving stones.

Although some solutions have been proposed to solve this problem, see for example U.S. Pat. No. 6,263,633 to Hagenah, the results have not been entirely satisfactory,

SUMMARY OF THE INVENTION

It is an object of the present invention to provide an interlocking paving stone having an upper part provided with linear sides and a lower part, hidden from the top, having a tongue and a groove system that allows vertical and lateral linkage all around four sides of the paving stone, and can be manufactured in a variety of sizes in order to create different patterns of installations.

In accordance with the invention, this object is achieved with an interlocking paving stone of rectangular or square shape, the stone having a width W, a length L, and a thickness H. Each side of the stone is provided with at least one pair of alternating tongues and grooves on a bottom part thereof, having a size and shape adapted to receive a corresponding tongue or groove of an adjacent block, where the groove has an overall volume greater than the volume of the tongue to facilitate the pouring of joint filling materials.

The length of a pair of tongue and groove is equal to a length I, where both W and L are whole multiples of I.

Further preferably, the tongues and grooves have a generally truncated pyramidal shape, where the peak of the truncated pyramid lies below the top surface of the block by 40 to 50% of the total height of the stones.

Further preferably, each side of the paving stone is further provided with a spacer located above each tongue, extending outwardly between the top surface and the terminating at the edge of the tongue to guarantee a certain minimum joint width.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF A PREFERRED EMBODIMENT OF THE INVENTION

The present invention concerns an interlocking paving stone which can accommodate both horizontal and vertical loads among stones, and easy to manufacture, and can be manufactured in rectangular or square shape and in different sizes to permit a variety of different patterns when assembled.

Figure 1:
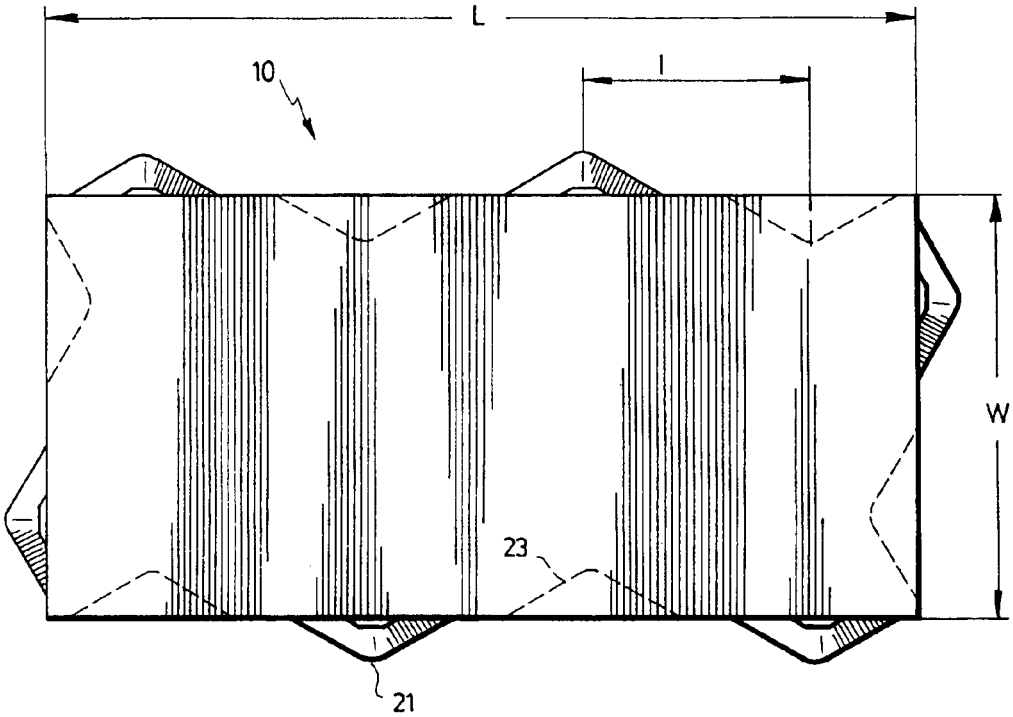
FIGS. 1 and 2 are a top plan view and side view of an interlocking paving stone according to a preferred embodiment of the invention and of a large rectangular stone, respectively.

FIG. 1 shows a plan view of a paving stone according to a preferred embodiment of the invention. The stone 10 has four sides, and a generally rectangular shapes. Each side of the stone is provided with at least one pair of tongue and groove.

The length of a pair of tongue and groove, such as that illustrated by 11 on FIG. 1 is l.

The stone has a length L and a width W, where both L and W are whole multiples of l.

Figure 2:
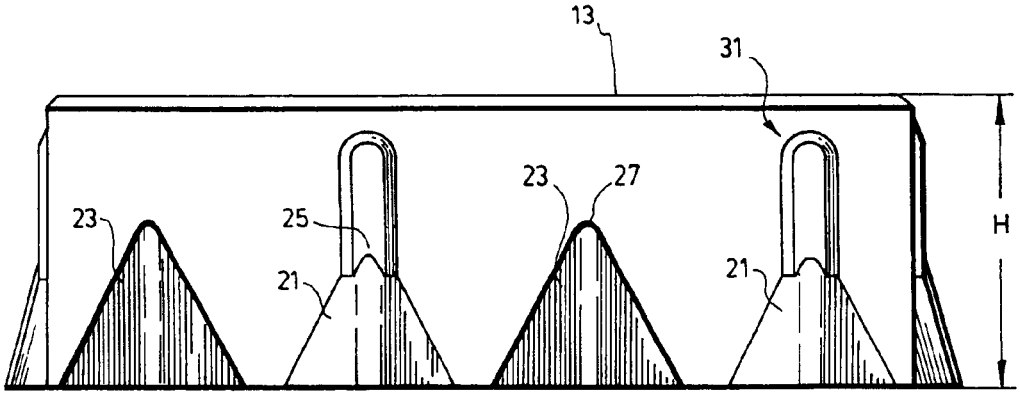
Figure 3:
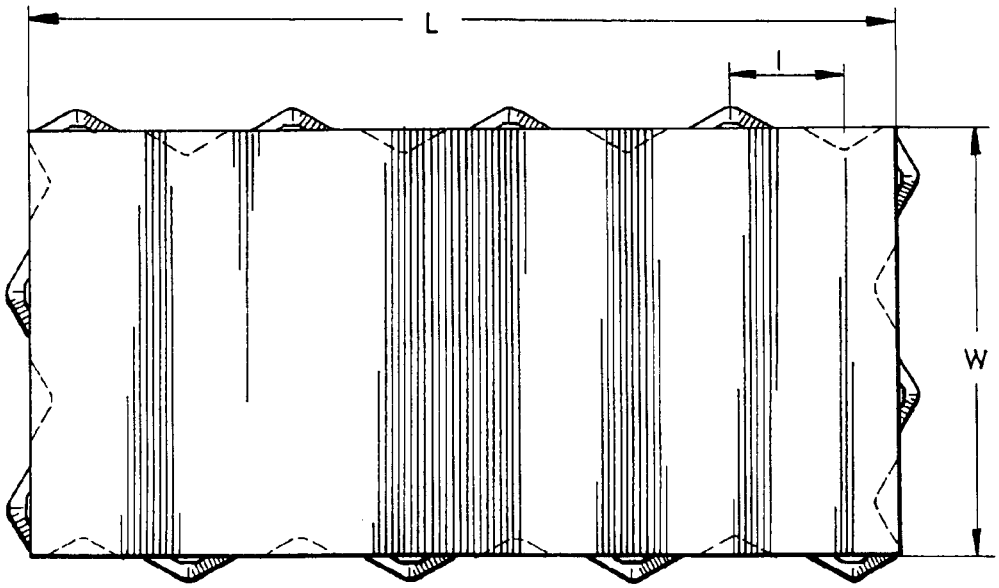
FIGS. 3 and 4 are a top plan view and a side view of an interlocking paving stone according to another preferred embodiment of the invention, respectively.
Figure 4:
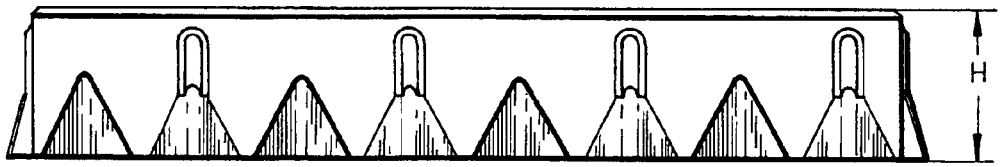
Figure 5:
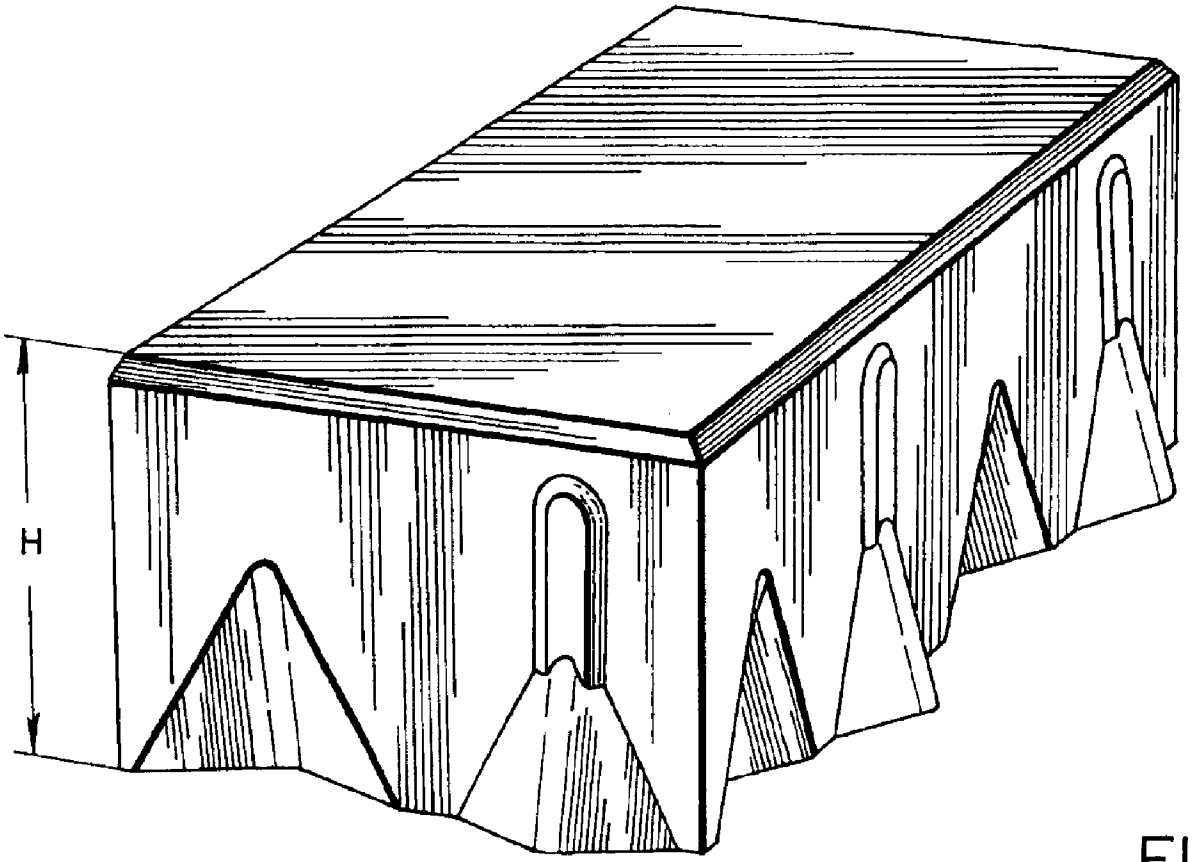
FIG. 5 is a perspective view of the stone of FIG. 1.

The tongue 21 and groove 23 each have the shape of a truncated pyramid, as better shown in FIGS. 1 and 2. Referring now to FIG. 1, the truncated pyramid and has an inclination of up to 15° and a peak 25, 27 which lies 40% to 50% of height lower than the top surface 13 of the stone 10. In other words, the height of the pyramid is a value which represents 50 to 60% of the total thickness H of the stone 10. It should however be understood that this value is a preferred embodiment of the invention, and that the peak may lie higher or lower, depending on the needs of a user.

Further preferably, the groove 23 has an interior volume that is greater than the outer volume of the tongue 21, i.e. the groove is larger than the tongue, so the inclination achieved by the volume differential facilitates the pouring of joint filling material therebetween Furthermore, as can be seen in FIGS. 1, 6, 7 and 8, the peak of the groove is higher th the peak of the tongue to facilitate the installation. So, for the worst case scenario, the tight joint, the clearance of installation is at least 15% the height of the paving stone.

Referring back to FIG. 1, the stone is provided with alternating pairs of tongues and grooves. In the embodiment shown in FIG. 1, each end is provided with only one pair of tongues and grooves, whereas each opposite side is provided with two pairs but it will be understood that other configurations fall within the scope of the present invention.

Figure 8:
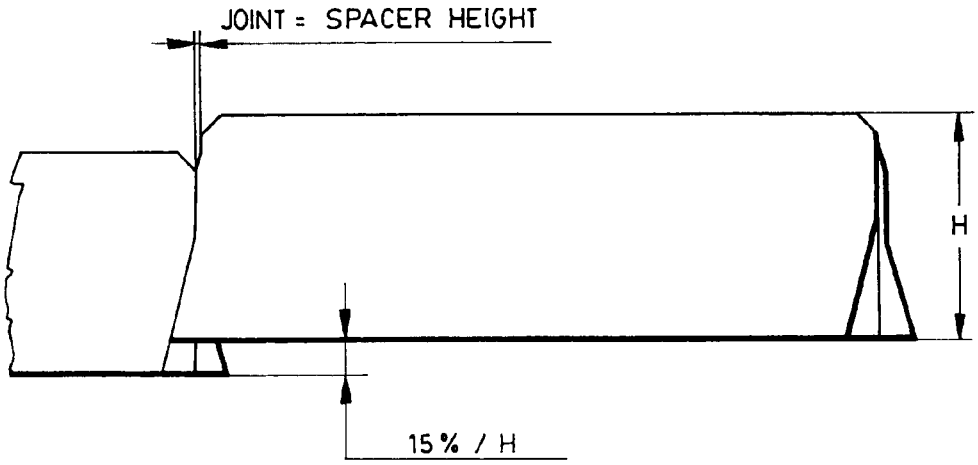
FIG. 8 is a side view of a plurality of stones showing the cleareance for installation with a tight joint.
Figure 9:
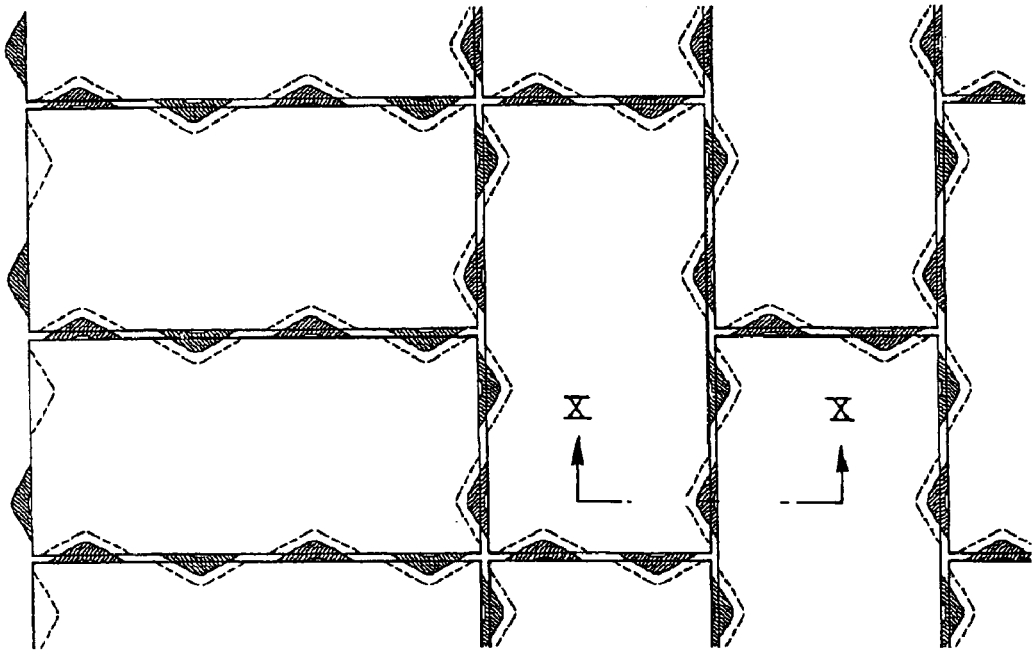
FIG. 9 is a schematic representation of the interlocking of a plurality of rectangular stones.
Figure 10:
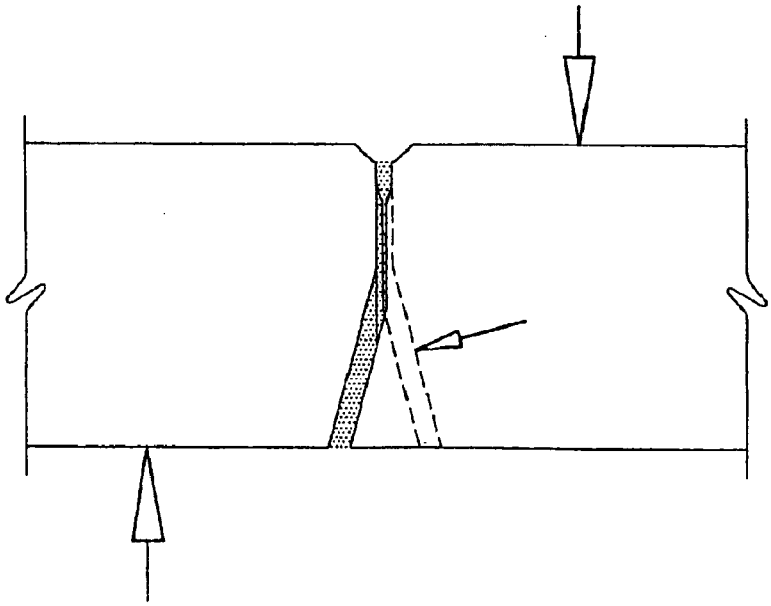
FIG 10 is a cross-sectional view taken along lines X—X of FIG 9.
Figure 11:
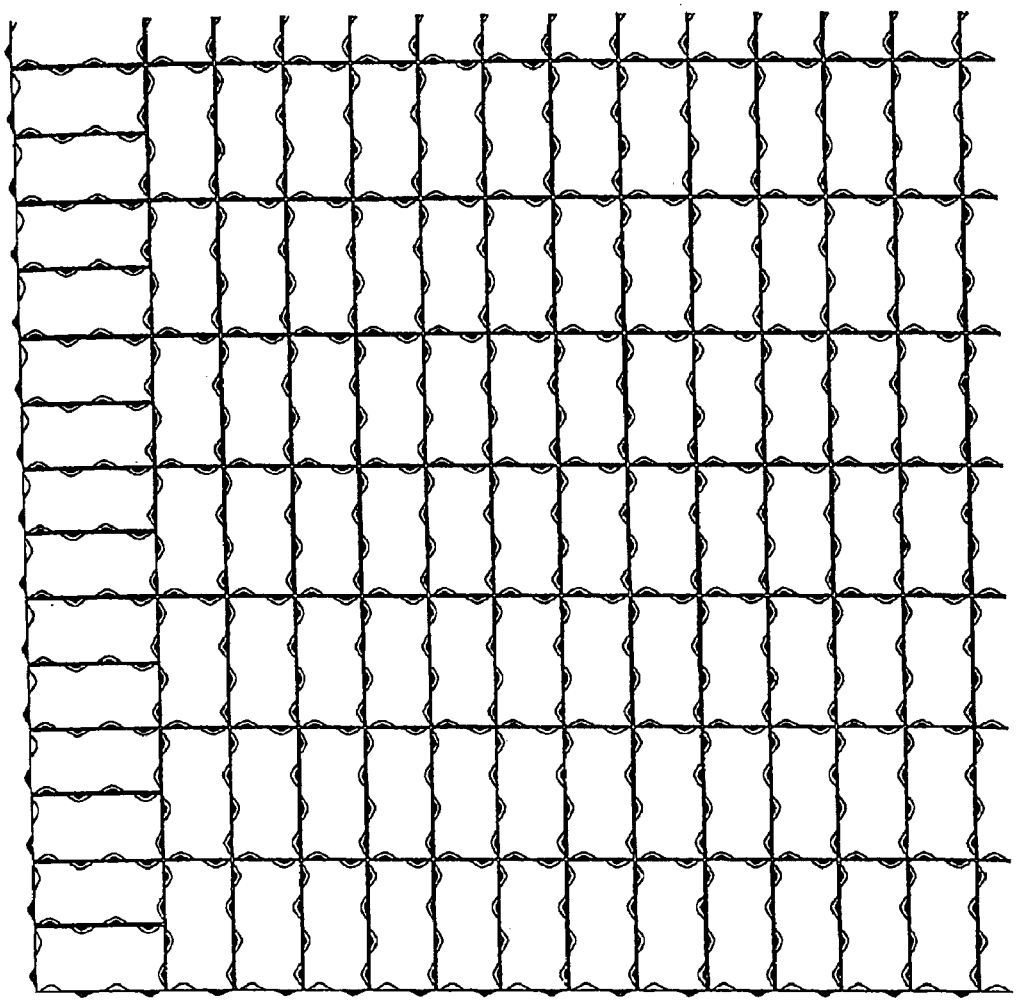
FIGS. 11 and 11*a* show a soldier course and basket weave pattern that can be realized with identical rectangular stones.
Figure 11A:
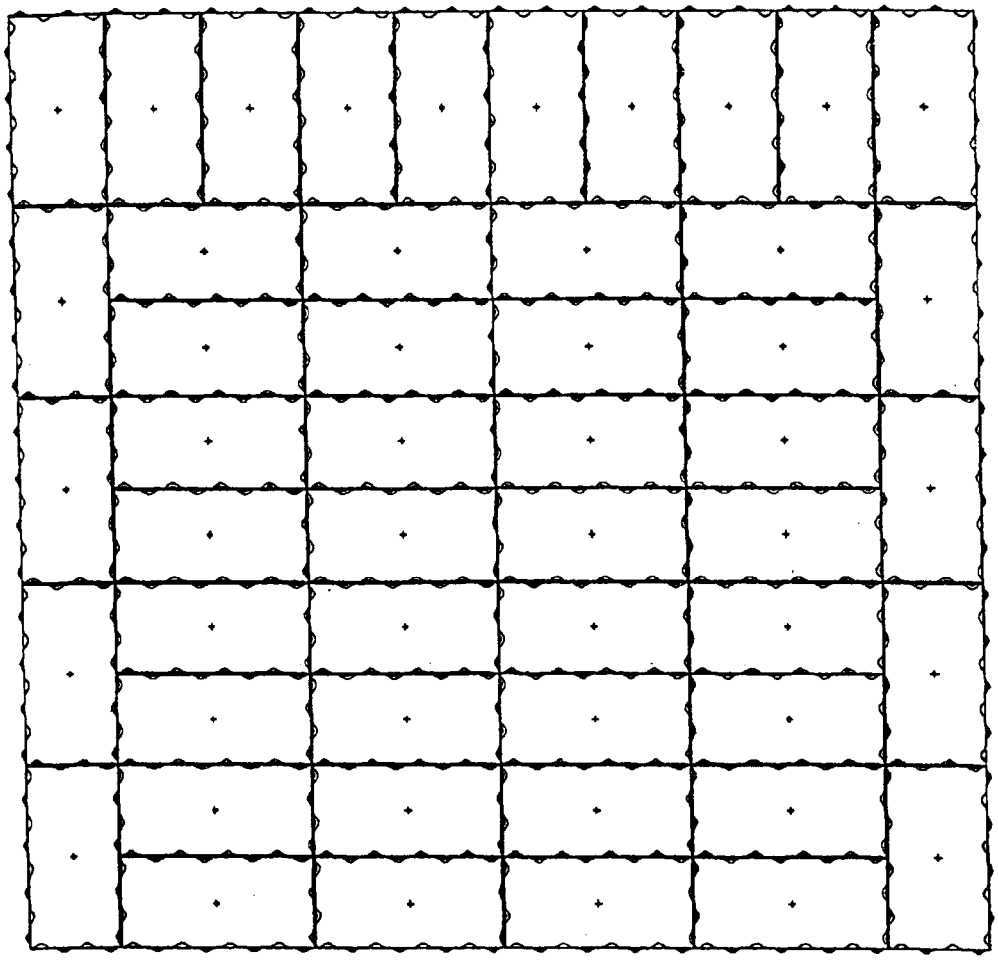
Figure 12:
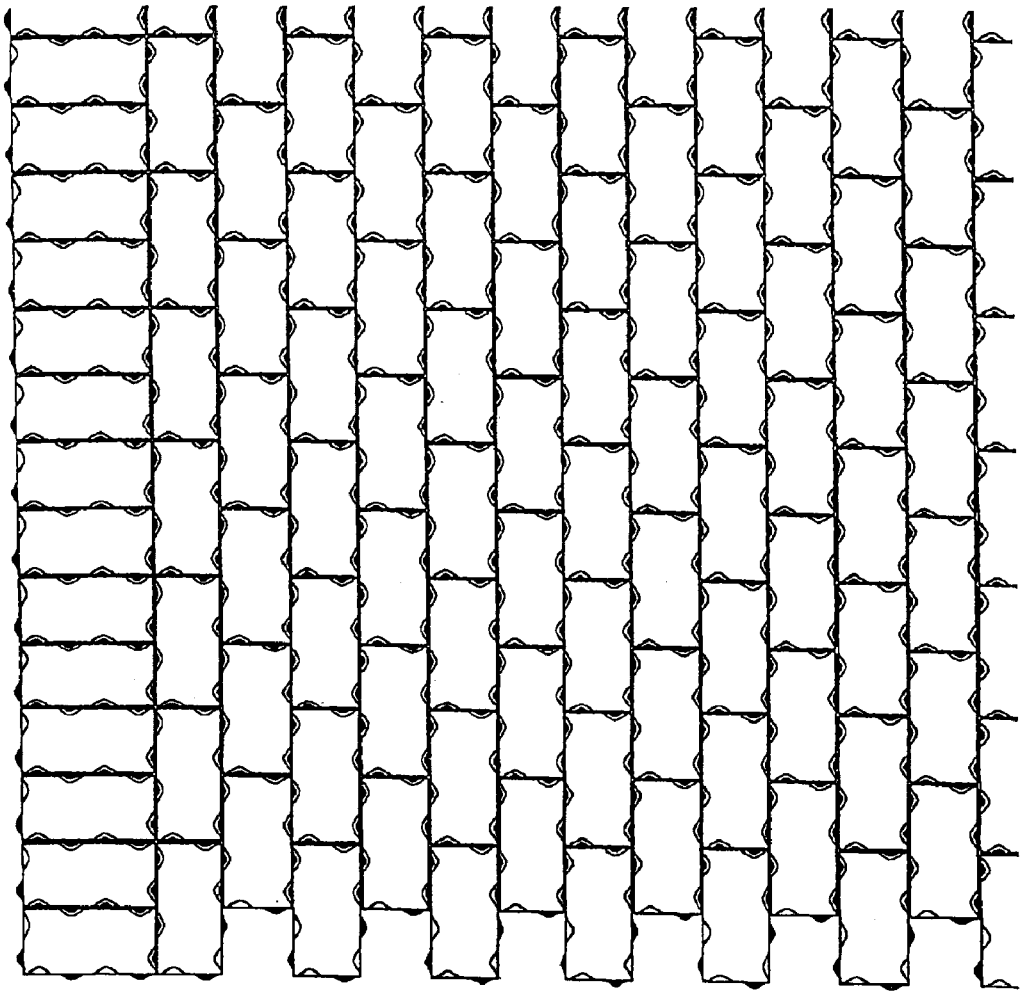
FIGS. 12 and 12*a* are a soldier course and running bone patterns realized with identical rectangular stones.
Figure 12A:
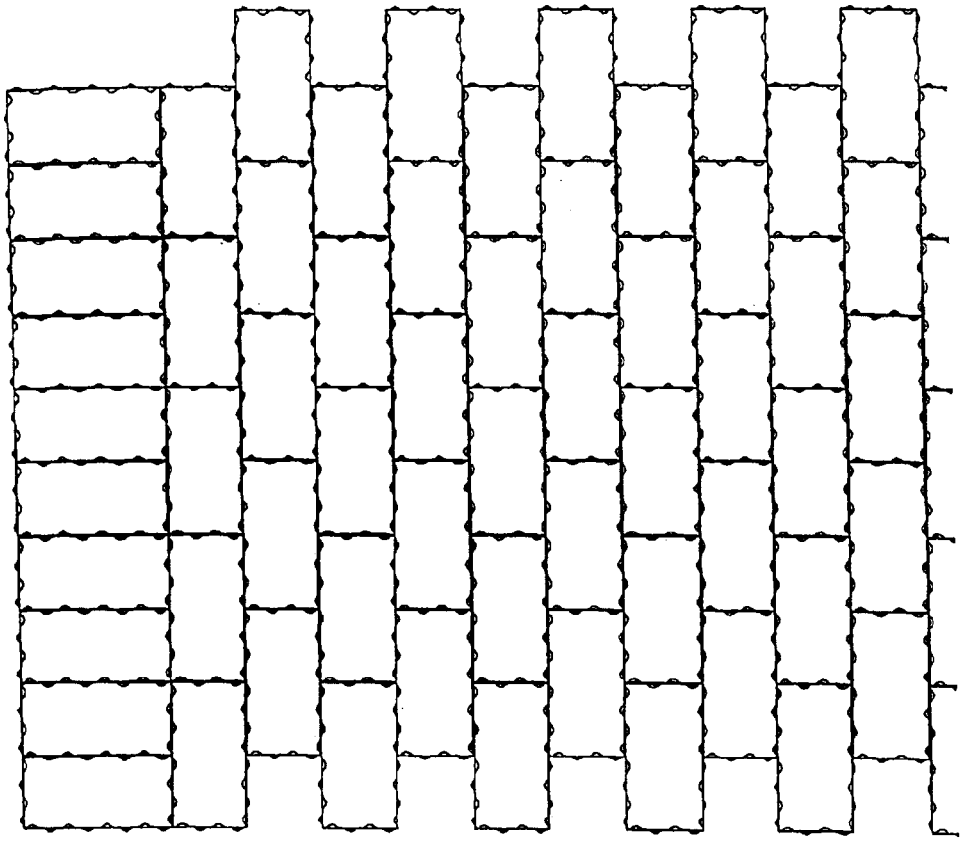
Figure 13:
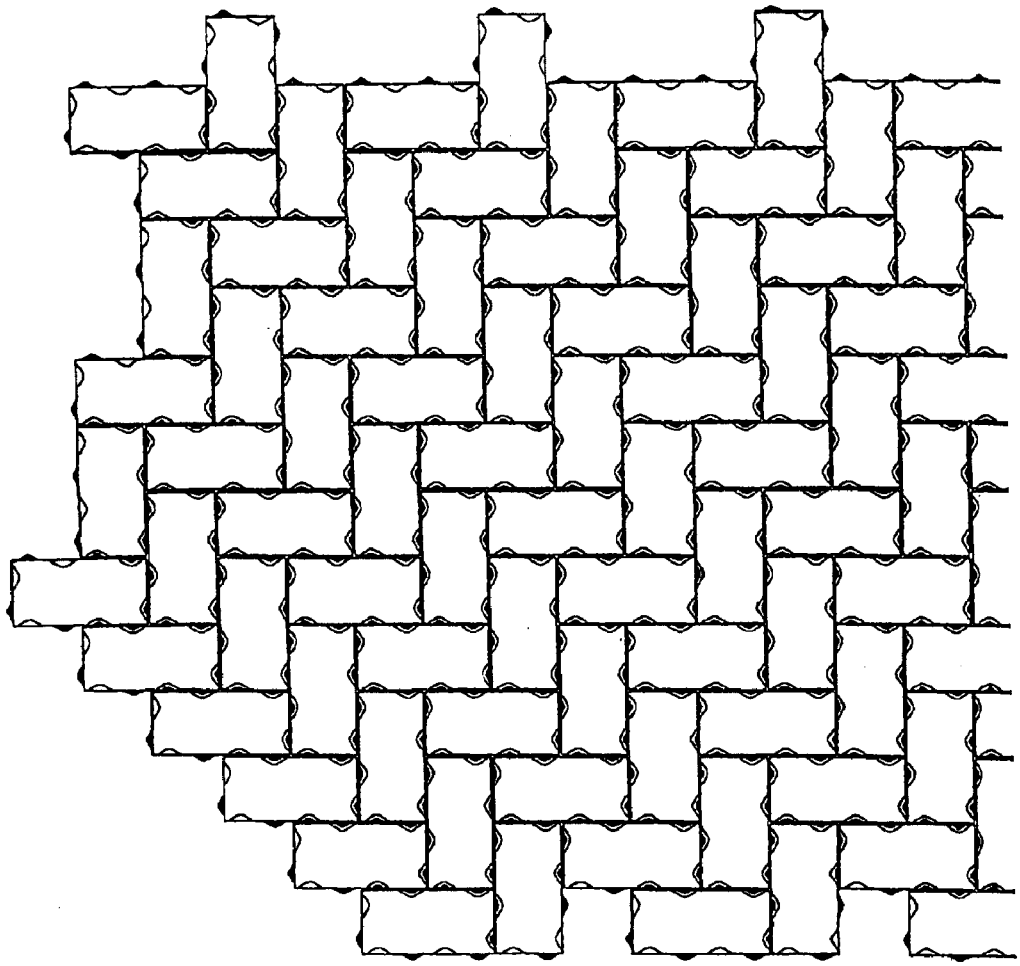
FIGS. 13 and 13*a* are a herring bone pattern realized with identical rectangular stones.
Figure 13A:
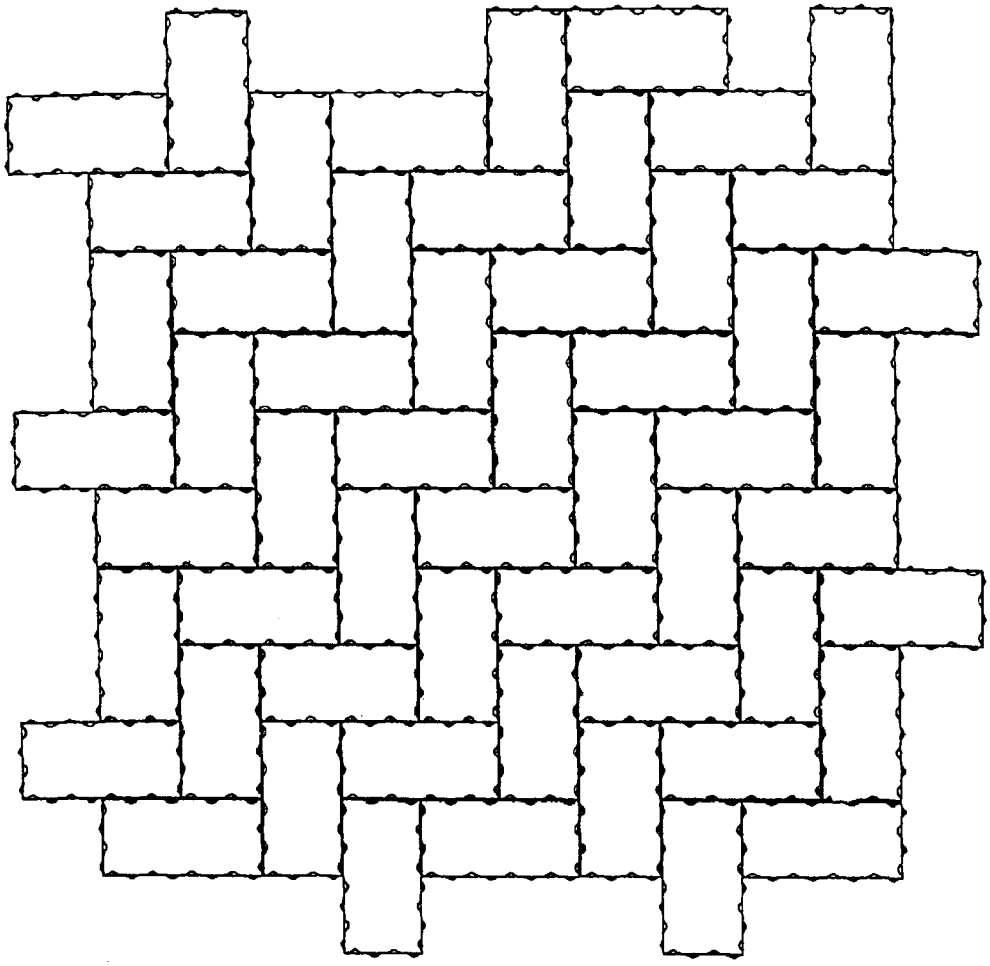
Figure 14:
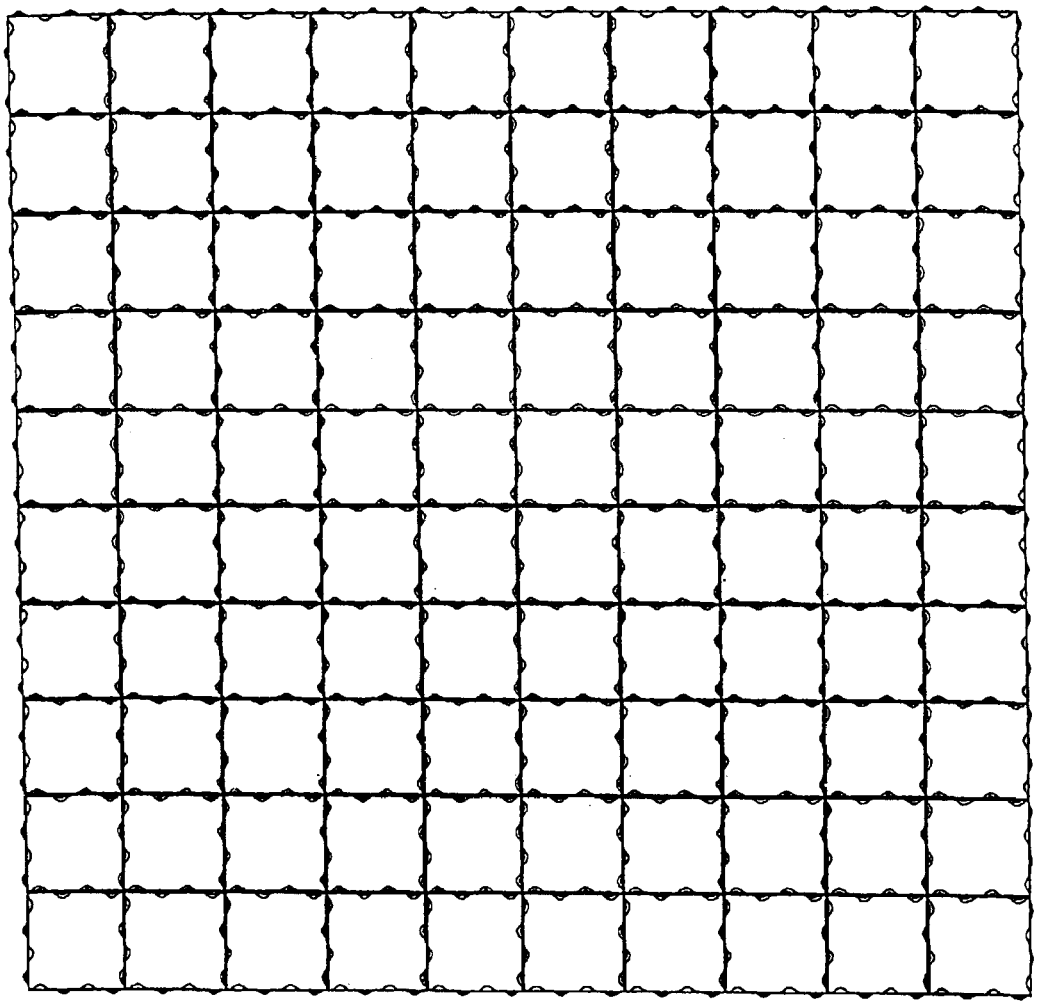
FIGS. 14 and 14*a* show a basket weave pattern that can be realized with square stones.
Figure 14A:
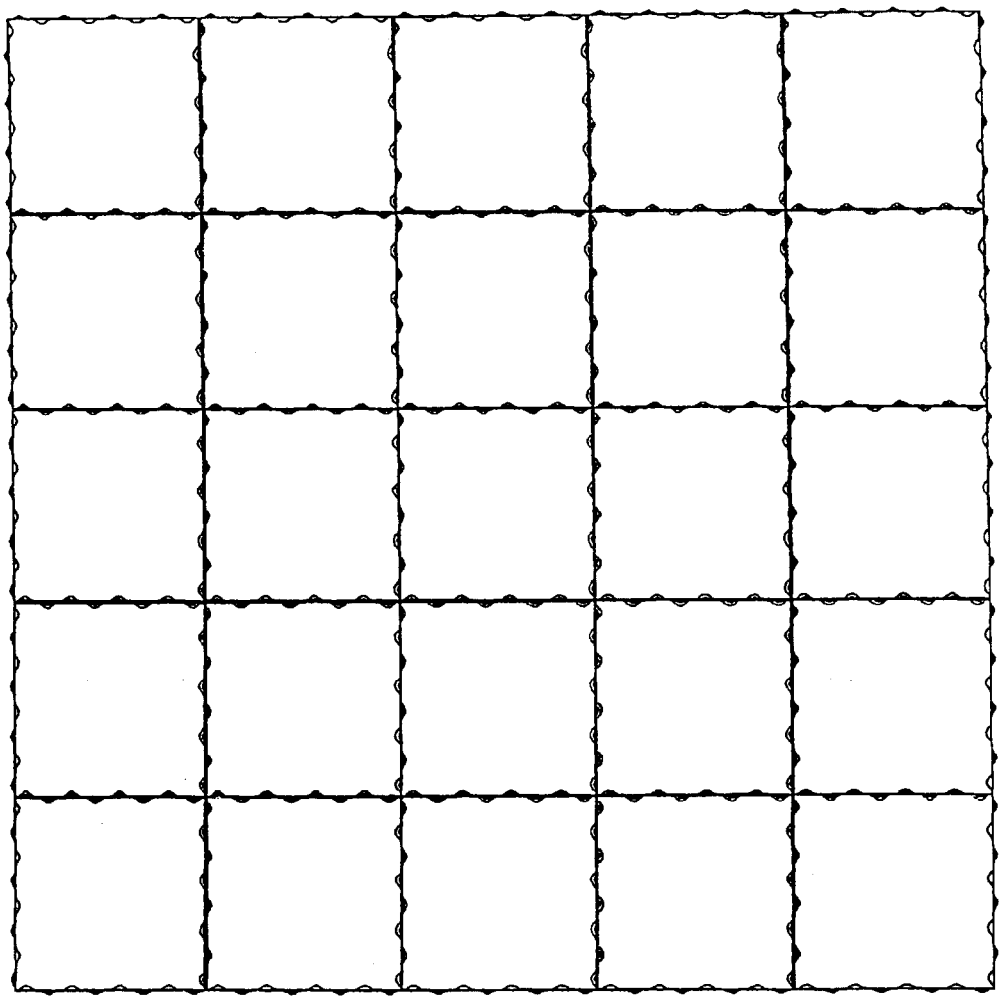
Figure 15:
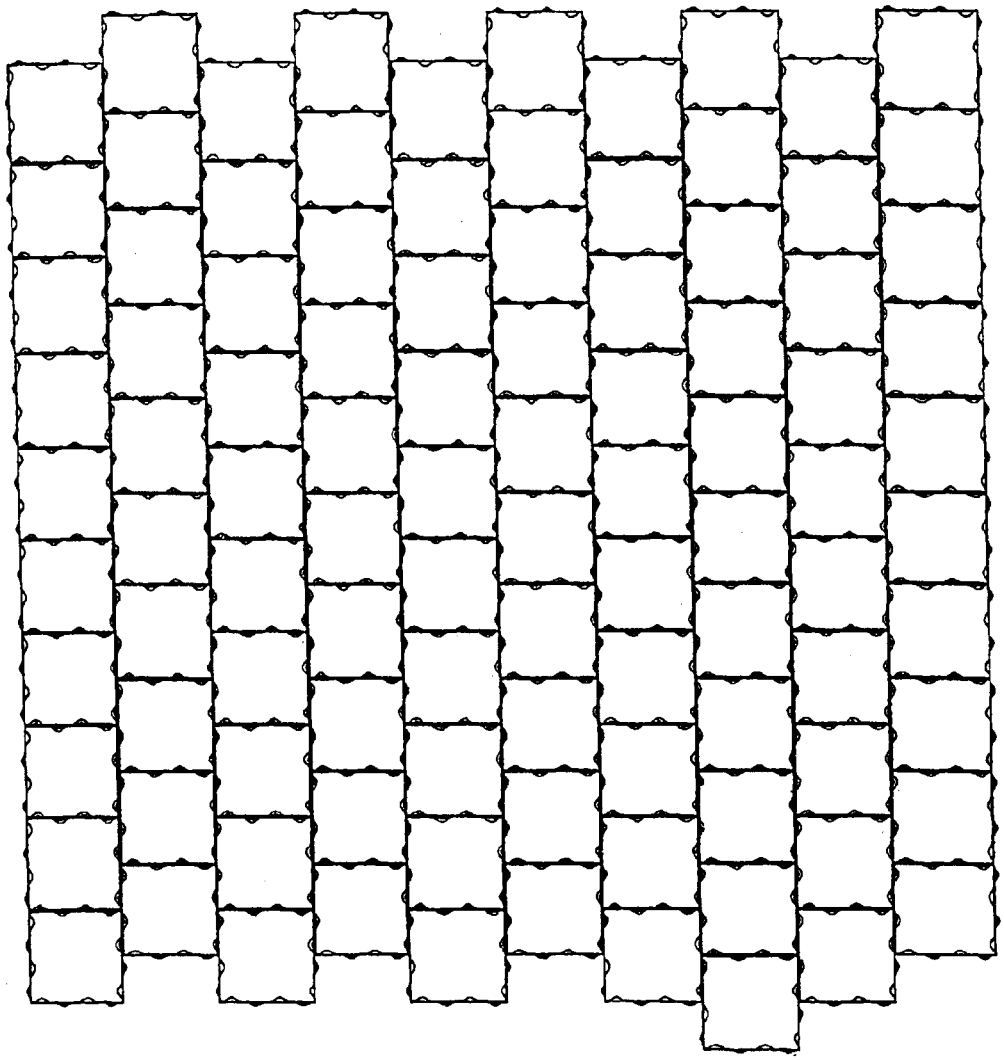
FIGS. 15 and 15*a* show a running bone pattern with a square stone.
Figure 15A:
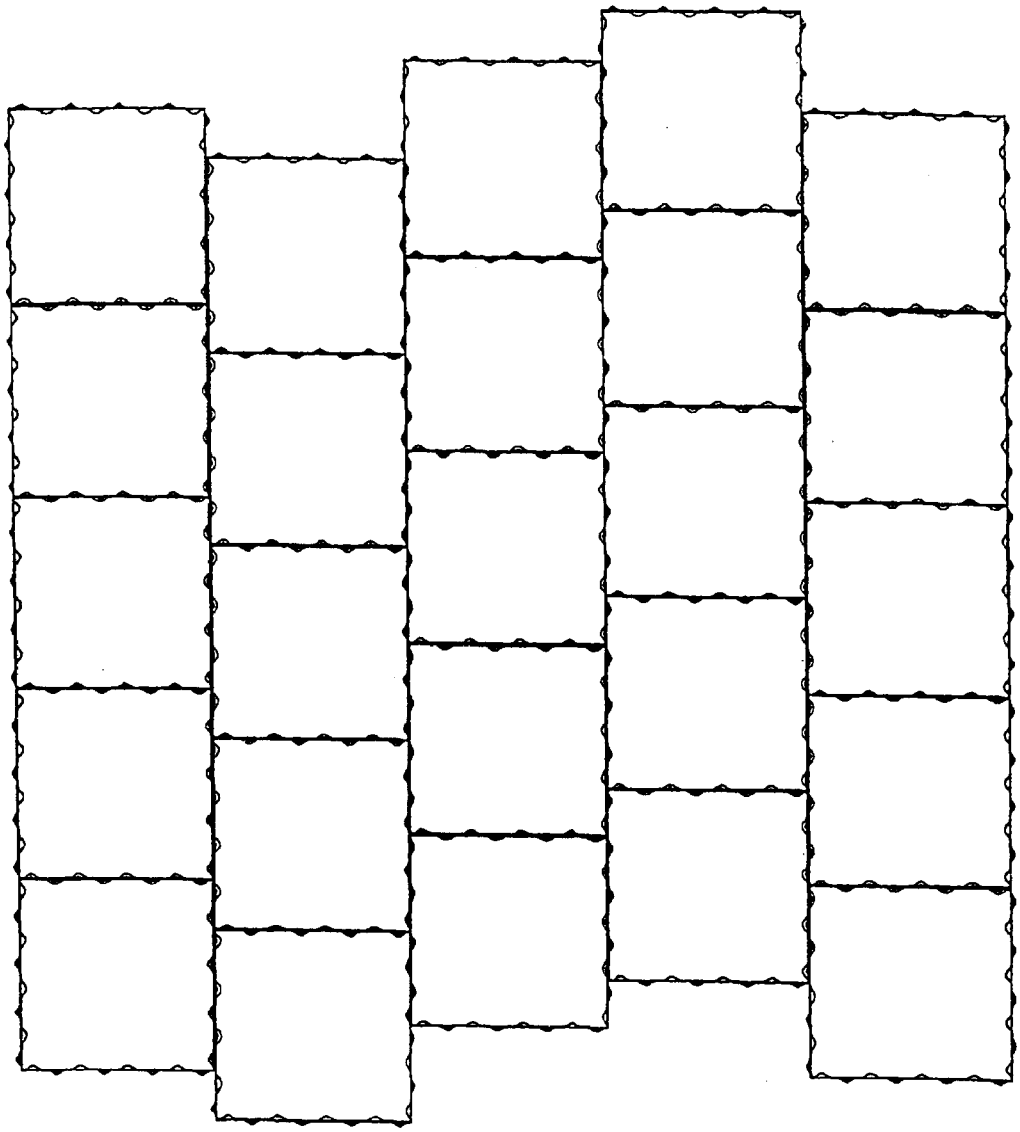
Figure 16:
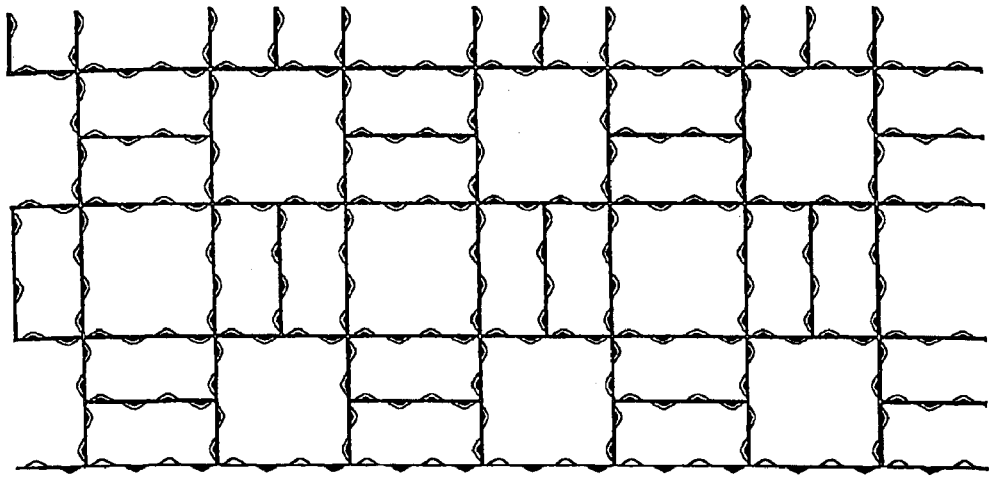
FIGS. 16 and 16*a* show a basket weave with rectangular and square stones.
Figure 16A:
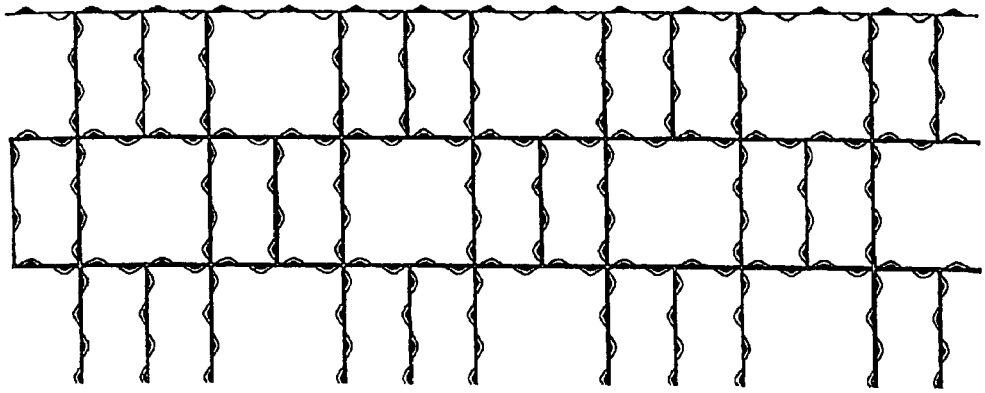
Figure 17:
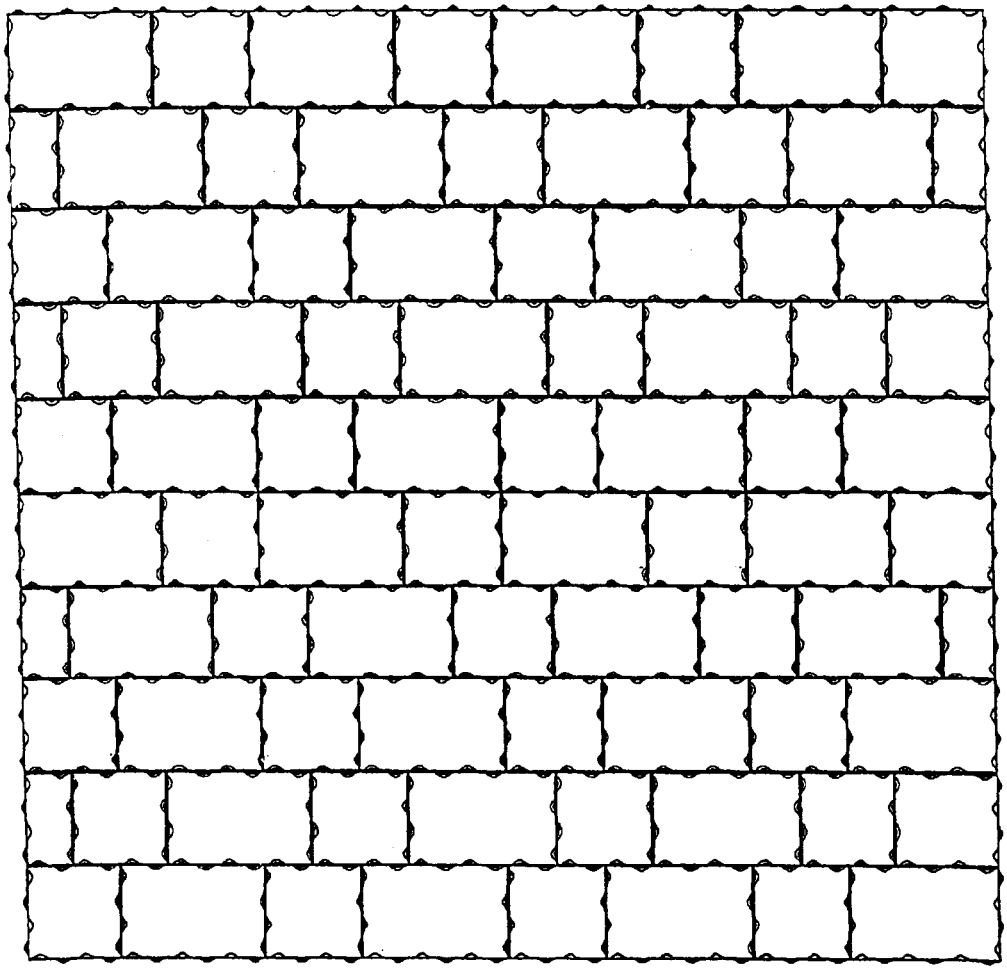
FIG. 17 shows a running bone pattern with three modular sizes of stones.
Figure 18:
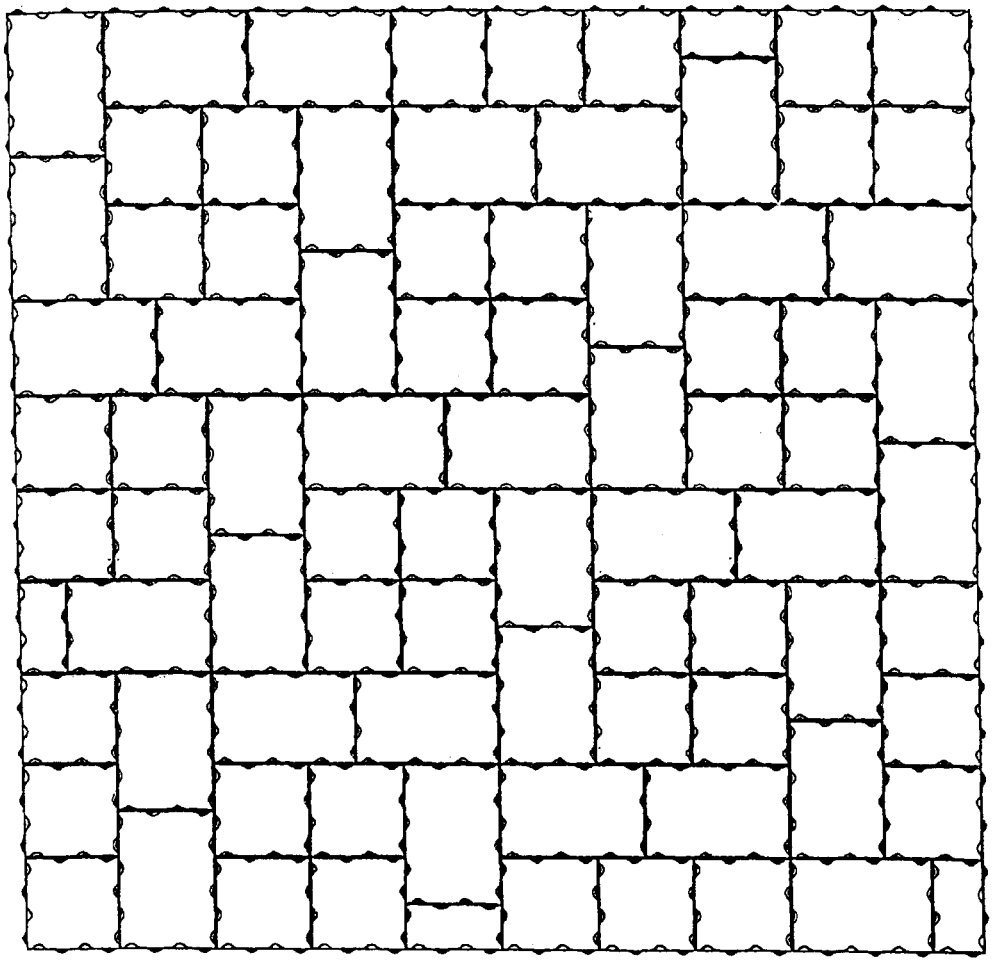
FIGS. 18 and 18*a* show modular patterns with three modular sizes of stones.
Figure 18A:
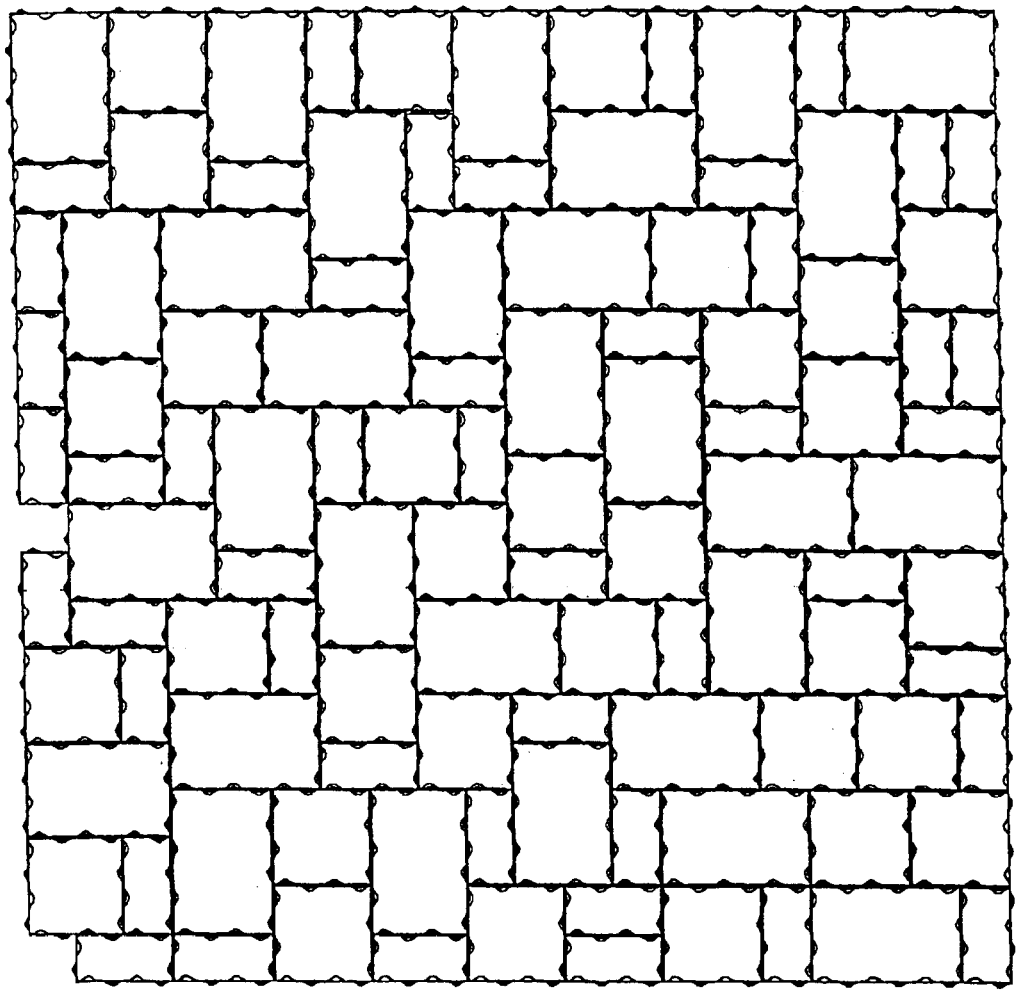

FIG. 8 is a representation of the assembly of a plurality of stones laid end-to-end. It can be seen that the insertion of the tongues into the groove, given the fact th t when filled with joint filling material, provide vertical stability to an assembled pavement on four sides of the paving stone. Furthermore, the interlocking effect allows for a better load distribution n the adjacent stones, offers a greater vertical stability and also provides lateral stability.

Figure 6:
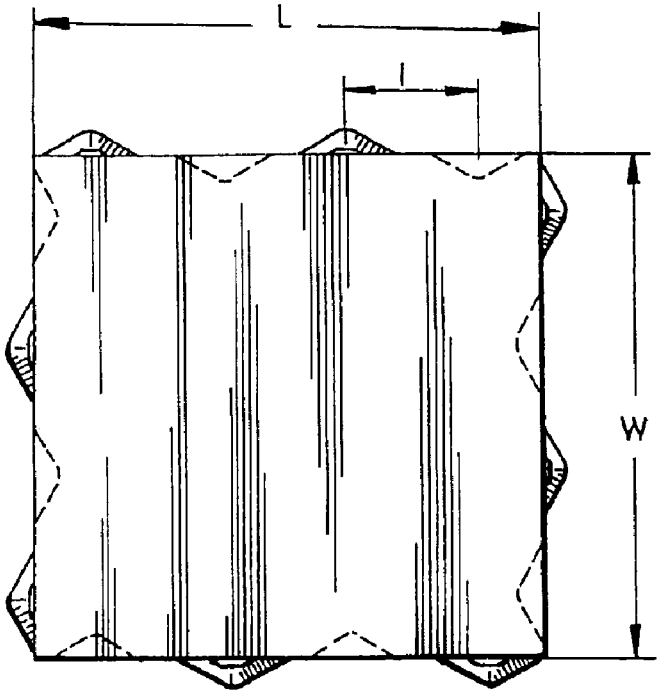
FIGS. 6 and 7 are a top view and side view of a square stone.
Figure 7:
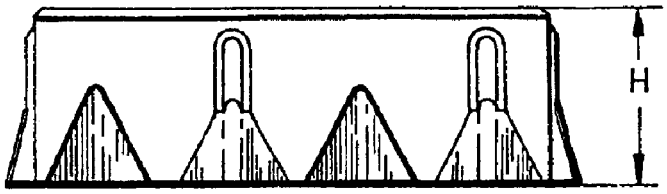

Further preferably, as shown in FIGS. 6 and 7, the stones are preferably provided with spacers 31 in order to guarantee a certain minimum joint with and to protect the perimeter of the stone during handling.

As shown, the preferred embodiment for the stone of the present invention is a rectangle or square. Such stones can be used to assemble, among others, patterns as shown in FIGS. 11–18*a*.

Alternatively, a combination of rectangular blocks can be used with square blocks to assemble pavements into the patterns shown in FIGS. 16, 16*a*, 17, 18 and 18*a*.

It will be understood that any other types of sizes of blocks can also be used, provided that these blocks have dimensions which are whole multiples of the length I of a tongue and groove pair.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. An interlocking paving stone having a width W, a length L and a thickness H and four sides, each side being provided with at least one pair of alternating tongues and grooves on a bottom part of aid sides, said tongues and grooves having a size and shape adapted to receive a corresponding tongue or groove of an adjacent block, the tongues and grooves on opposed sides of said block being offset from each other to permit a plurality of the stones to be interlocked having a top part of the said sides of adjacent stones proximate each other, and wherein each tongue and groove of each of said at least one pair of alternating tongues and grooves has a generally truncated pyramidal shape, where a peak of said generally pyramidal shape lies below top surface of said paving stone.

2. An interlocking paving stone according to claim 1, wherein each of said at least one pair of alternating tongues and grooves has a length l, and wherein said width W and said length L are whole multiples of said length l.

3. An interlocking paving stone according to claim 1, wherein said peak lies below said top surface by a distance corresponding to 40 to 50% of the thickness H.

4. An interlocking paving stone according to claim 1, wherein an interior volume of said groove is greater than an exterior volume of said tongue for each of said at least one pair of alternating tongues and grooves.

5. An interlocking paving stone according to claim 1, wherein each side of said stone is provided with at least one spacer located at a top portion of said side.

6. An interlocking paving stone according to claim 5, wherein each of said at least one spacer lies above a corresponding groove.

* * * * *